US007821330B2

(12) United States Patent
Wang et al.

(10) Patent No.: US 7,821,330 B2
(45) Date of Patent: Oct. 26, 2010

(54) METHOD AND APPARATUS FOR EXTENDING THE LIFETIME OF A SEMICONDUCTOR CHIP

(75) Inventors: Ping-Chuan Wang, Hopewell Junction, NY (US); Jong-ru Guo, Wappingers Falls, NY (US); Louis L. Hsu, Fishkill, NY (US); Zhijian Yang, Stormville, NY (US)

(73) Assignee: International Business Machines Corporation, Armonk, NY (US)

( * ) Notice: Subject to any disclaimer, the term of this patent is extended or adjusted under 35 U.S.C. 154(b) by 105 days.

(21) Appl. No.: 12/045,974

(22) Filed: Mar. 11, 2008

(65) Prior Publication Data

US 2009/0231025 A1 Sep. 17, 2009

(51) Int. Cl.
*G05F 1/10* (2006.01)

(52) U.S. Cl. ..... 327/538; 327/530; 327/540; 323/313

(58) Field of Classification Search ..... 327/530, 327/531, 538, 539, 540, 541; 323/313–314
See application file for complete search history.

(56) References Cited

U.S. PATENT DOCUMENTS 6,211,727 B1 4/2001 Carobolante
6,396,739 B2 * 5/2002 Briner ..... 365/185.2
6,483,375 B1 11/2002 Zhang et al.
6,700,363 B2 * 3/2004 Tachimori ..... 323/313
6,774,713 B2 * 8/2004 Watanabe ..... 327/540
6,883,152 B2 4/2005 Bednar et al.
6,958,621 B2 10/2005 La Rosa et al.
2005/0168271 A1 * 8/2005 Brox ..... 327/540
2005/0280463 A1 * 12/2005 Chih ..... 327/538
2006/0103451 A1 * 5/2006 Lim et al. ..... 327/540

OTHER PUBLICATIONS

U.S. Appl. No. 11/832,796, Titled "Method And Apparatus To Measure Threshold Shifting Of A MOSFET Device And Voltage Difference Between Nodes" Hsu, et al. filed Aug. 2, 2007.

* cited by examiner

*Primary Examiner*—Lincoln Donovan
*Assistant Examiner*—Shikha Goyal
(74) *Attorney, Agent, or Firm*—H. Daniel Schnurmann

(57) ABSTRACT

A circuit and a method for extending the lifetime of a semiconductor chip. The circuit including a voltage reference generator, a voltage switch, a threshold voltage regulator device and a threshold voltage monitor device tunes an automatic internal power supply. The voltage reference generator provides one or more reference voltage levels that are transmitted to the voltage switch. The threshold voltage monitor device monitors the threshold voltage of the device, triggering the voltage switch to select a reference level for use as a voltage reference for the regulator when the threshold voltage of the monitored device exceeds a predetermined value. The regulator then converts the external power supply to an internal supply and holds it at the predetermined reference level.

19 Claims, 4 Drawing Sheets

METHOD AND APPARATUS FOR EXTENDING THE LIFETIME OF A SEMICONDUCTOR CHIP

FIELD OF THE INVENTION

This invention relates generally to CMOS devices, and more particularly to a method for extending the lifetime of a semiconductor chip in accordance to its level of degradation.

BACKGROUND OF THE INVENTION

Semiconductor CMOS devices and circuits have been widely employed in systems ranging from satellite and undersea communication routers to personal electronic gadgets.

It is known in the semiconductor industry that certain physical properties associated with solid-state devices are subject to a variety of mechanical, electrical and/or chemical failure mechanisms. It is also known that elements such as transistors from both CMOS and bipolar technologies are susceptible during product use to certain reliability wear-out mechanisms that can severely impact the efficient operation of a circuit design.

As the device size scales down to respond to the ever increasing demand for speed, the impact of device reliability wear-out on the circuit lifetime becomes more significant. Thus, a large number of reliability rules and guidelines need to be complied with during the circuit design and manufacture stages. Most common wear-out mechanisms include hot carrier effect (HCE) for both nMOSFET and pMOSFET devices, negative bias temperature instability (NBTI) for pMOSFETs and positive bias temperature instability (PBTI) for nMOSFETs. During a device normal operation, these wear-out mechanisms increase the threshold voltages of the devices, resulting in higher turn-on voltages and less driving currents. One example is the widely observed SRAM circuit failure caused by the threshold voltage increase of pMOSFET as induced by NBTI effect.

A conventional method for minimizing device wear-out (also referred to as degradation) is to comply with reliability rules that specify, for example, minimum device sizes, maximum power supply voltages Vdd, minimum and maximum temperatures, maximum allowable operation times or lifetime, and the like. For systems having high reliability requirements, these restrictions greatly burden the circuit designers and manufacturers, and have become a serious challenge and a major task to extend the circuit lifetime without compromising the product reliability.

One method for extending the MOSFET lifetime is to recover some degree of wear-out. For example, U.S. Pat. No. 6,958,621 to La Rosa et al., of common assignee, describes a method that employs thermal annealing method to partially recover NBTI degradation. The drawback of such recovery technique is that it is very difficult to completely recover all the degraded devices in typical VLSI circuits due to the large amount of individual devices, i.e., in the millions of devices. Furthermore, the recovering process is not only time and power consuming but it is also cumbersome, as for instance, having to shut down the chip during recovery mode. Therefore, this method is not practical, especially when the system is formed by a large number of chips.

Other related references on automatic circuit level power control include;

U.S. Pat. No. 6,483,375 to Zang et al. describes how to reduce the leakage current by decreasing Vdd or increasing the substrate bias by way of a chip driving apparatus having voltage regulating devices that drives chip in normal and lower power mode by applying specific voltage to specific electrodes of transistor.

U.S. Pat. No. 6,211,727 to Carobolante describes how to adjust the power supply voltage by a control signal. It further describes an intelligent supply voltage regulator that includes a voltage regulating circuit for adjusting the power supply voltage to served device in response to control the signal from the discriminator circuit.

Additionally, voltage islands that include automatic power supply circuits are described in commonly assigned U.S. Pat. No. 6,883,152 to Bednar et al.

In view of the foregoing, there is a need in industry for a method of extending the circuit lifetime by boosting the power supply levels.

OBJECTS AND SUMMARY OF THE INVENTION

Thus, it is a primary object of the present invention to provide a circuit and a method for extending the lifetime of semiconductor chips by measuring chip degradation.

It is another object to measure the chip degradation by probing threshold voltages of at least one device powered by a supply voltage, and determining the existence of a chip degradation state by determining when the threshold voltages exceed a predetermined value.

It is still another object to provide a circuit that uses an increased Vdd power supply at the end of the circuit lifetime, resulting in extending the circuit lifetime by at least 20%.

It is yet another object to have the Vdd supply increase by no more than 10% to compensate for the circuit and/or chip degradation, thereby extending the circuit normal operation lifetime.

It is a further object to monitor the threshold voltage Vt, preferably of one reference device such that when Vt exceeds a predefined value of Vt_h, the power supply automatically adjusts by a fraction of the Vdd value, e.g., Vdd'=(Vdd+X) mv.

These and other objects, aspects and advantages of the invention are achieved by a circuit and a method set to significantly and automatically extend the lifetime of semiconductor chips, where the power supply level of a MOSFET chip is raised by a fraction when its chip degradation exceeds a certain predetermined level. Monitoring devices are strategically distributed across the chip, which are subjected to normal or to a slightly higher stress than the rest of the active devices. The monitoring devices are periodically sampled and their threshold voltage levels are compared with a predetermined level to trigger power supply adjustment. Preferably, voltage islands are employed to exercise voltage regulation and adjustment based on the chip degradation.

In one aspect of the invention, the circuit extends its lifetime by slightly increasing the power supply voltage at the end of normal circuit lifetime. This approach can be easily applied to whole circuits so that different kinds of devices can benefit at the same time. Unlike conventional degradation recovery methods, the present method is capable of automatically repairing any chip degradation problem without shutting down the circuits. It can easily be applied to any semiconductor circuit without having to trace complex degradation mechanisms in detail.

In another aspect of the invention, there is provided a method of extending a semiconductor device lifetime that includes the steps of: a) increasing an internal power supply voltage to be activated when chip degradation reaches a normal end of lifetime level; b) monitoring the chip degradation by assessing the device performance parameters or device characteristics; and c) tuning the power supply voltages by adding discrete increments as a function of the chip degradation.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, where:

DETAIL DESCRIPTION AND PREFERRED EMBODIMENTS

Figure 1:
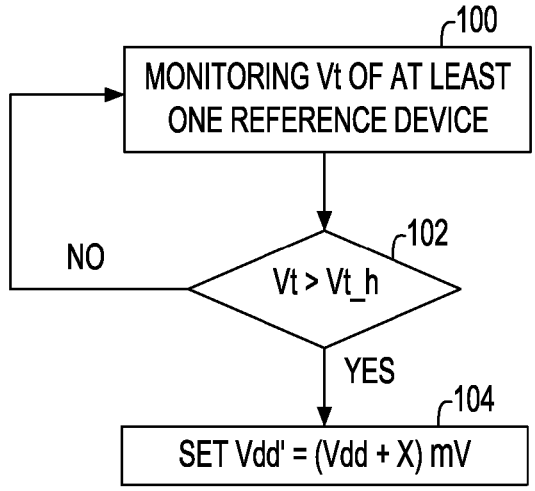
FIG. 1 is a diagram showing a flow chart illustrating method steps for monitoring Vt and adjusting Vdd to a new value.

Considering the problems caused by the aforementioned chip degradation, the circuit lifetime can be advantageously extended by dynamically modifying the operating conditions of the circuit approaching the end of its normal operating lifetime. One of the basic conditions in conventional reliability guidelines concerns the power supply voltage Vdd, which is a fixed design parameter, and cannot be altered during the operation lifetime. Typically, a 10% Vdd margin is allowed for the circuit design, that is, the reliability of, e.g., a 1.0V Vdd circuit is actually projected based on the requirement for 1.1V operation. In other words, Vdd increasing to up of 10% does not cause a severe impact on the projected device reliability, and therefore, does not cause premature circuit failure assuming that the reliability of other circuit components (such as electromigration present in the interconnects) has been incorporated into the design to be at least 10% higher than the target power supply level. Therefore, the circuit normal operation can be extended for a considerable period of time beyond the normal end of life provided that the circuit Vdd voltage can be increased by up to 10% at the end of its standard lifetime.

By way of example, for a typical MOSFET at the end of lifetime, the increase in its turn-on voltage (or threshold voltage, Vt) is approximately 60 mV. If Vdd is then increased by an amount similar to the Vt shift at the end of lifetime, the effect of the threshold voltage degradation can be fully compensated, and the circuit lifetime correspondently extended. Typically, the extended lifetime can be as high as 50% of the normal lifetime by simply boosting Vdd by up to 10%.

Referring back to the previous example of a 1.0V Vdd circuit, the projected lifetime for a 1.1V operation (i.e., 10% higher than the normal 1.0 V operating condition) is more than 20% of that at 1.0V. Therefore, a 20% lifetime extension can be expected by applying 1.1V Vdd at the end of the 1.0V normal operating lifetime.

Referring now to the drawings and in particular to FIG. 1, there is shown a flow chart illustrative of an embodiment of the present invention, and more particularly showing how during normal device operation time, a reference device (or a device representing the normal operation) within the main circuit is monitored by a threshold voltage monitor (100). The reference device remains below its lifetime target Vt_h, (102), and the circuit operates under normal conditions at a given value of the Vdd power supply.

When the threshold voltage of the reference device degrades (increases) to a value higher than the lifetime target Vt_h, it is indicative that the circuit has degraded to a worn-out stage characteristic of its end of life. At this point, the power supply regulator is set to increase the supply voltage from Vdd to Vdd'=(Vdd+X) mv, (104). The voltage increase X is set to a value comparable to the threshold voltage increase. Thus, the increase of the threshold voltage is shown to be offset by the increase of the power supply voltage.

Figure 2:
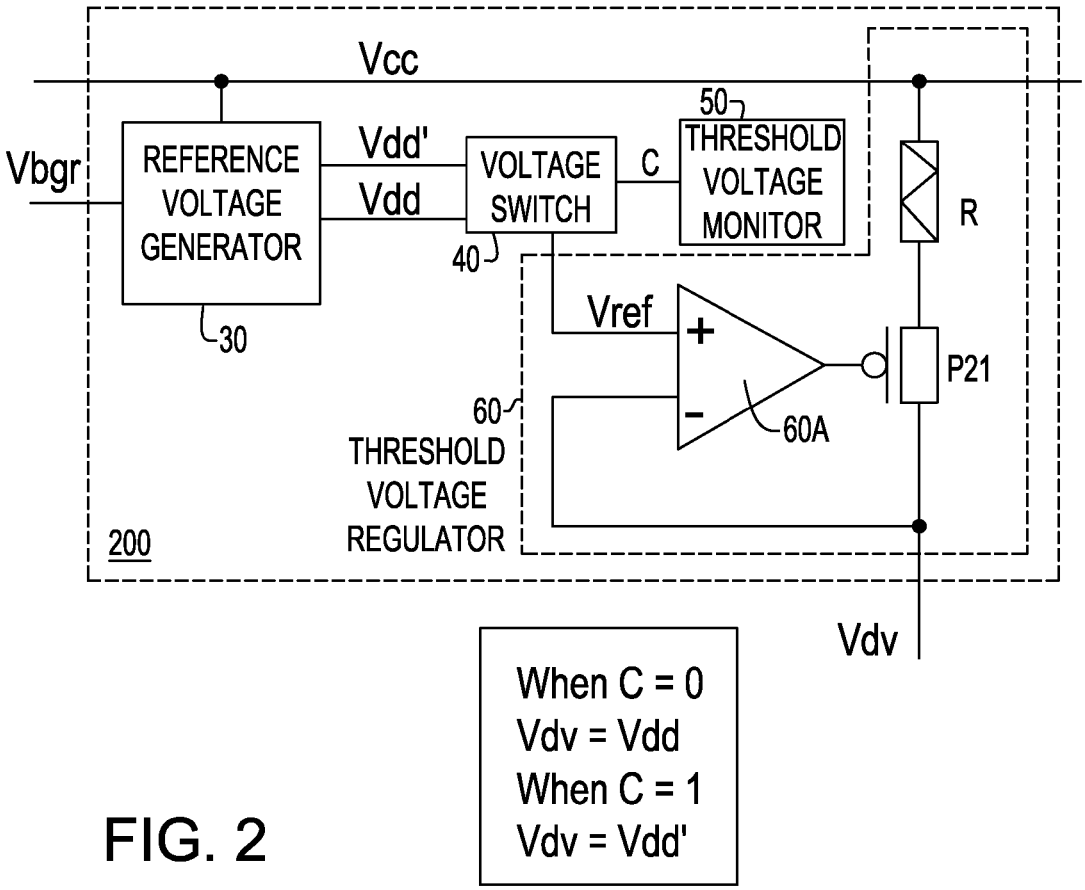
FIG. 2 shows a first embodiment of the invention that illustrates how the reference voltage generator adjusts the value of Vdd to a new incremental value Vdd'.

Referring now to FIG. 2, there is shown a sub-circuit 200 for controlling the circuit power supply voltage based on the level of chip degradation. For illustrative purposes, the power supply voltage for the circuit (system) is shown to be Vcc, while the main circuit power supply voltage is Vdv, which is regulated by a threshold voltage regulator 60. A control block is provided by way of reference voltage generator 30 which has two voltage outputs, namely, the circuit voltage Vdd before lifetime-extending mode and a circuit voltage Vdd' corresponding to the lifetime-extending mode, with Vdd'=(Vdd+X), X being approximately 60 mV.

Circuit degradation is monitored by threshold voltage monitor block 50 which sends an output control signal C to the voltage switch 40. Voltage switch 40 switches the output voltage Vref from Vdd to Vdd' according to the degradation monitor control signal C. If the chip degradation is below a predefined criterion, Vref remains at the original (normal) power supply voltage Vdd; otherwise, Vref switches to Vdd'. Accordingly, the power supply voltage of the main circuit Vdv=Vref, which is equal to Vdd and Vd' under normal operating conditions and lifetime-extending mode, respectively.

The threshold voltage regulator block 60 is provided with an operating amplifier (OPAMP) 60A controlling a pMOSFET switch device P21, and a resistive element R attached to P21. With a negative feedback arrangement, the drain voltage of P21 Vdv remains always clamped at Vref. An nMOSFET device can be advantageously used to replace the pMOSFET device simply by swapping the polarity of the two input pins of the OPAMP 60A.

Figure 3:
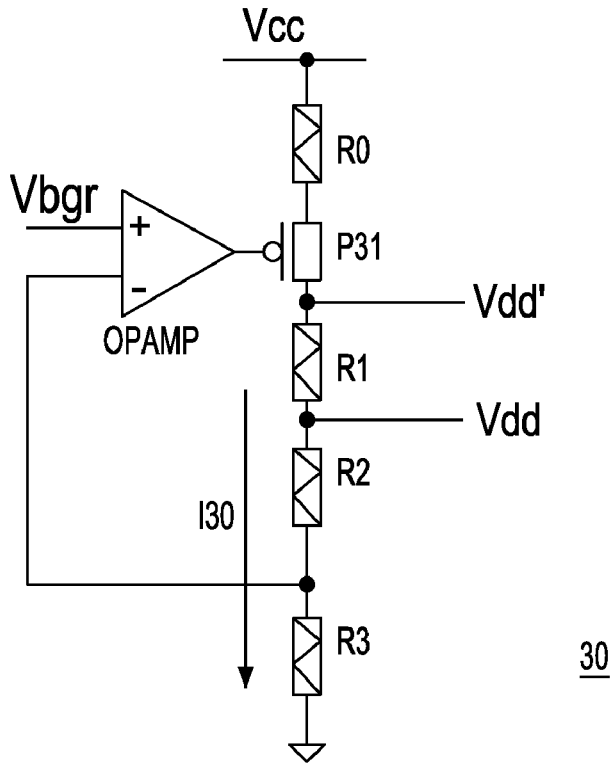
FIG. 3 is a schematic circuit diagram showing the reference voltage generator of the present invention.

Referring now to FIG. 3, the reference voltage generator 30 is shown having an operating amplifier (OPAMP) whose inputs are connected to the reference voltage Vbgr and to a feedback path. Vbgr is preferably fed from either an external voltage generator or from an internal band-gap voltage generator, where the voltage generator provides a stable voltage that is independent of temperature and process variations. The output voltage of operation amplifier OPAMP tracks the value of the band-gap reference voltage Vbgr so that Vdd'=(Vbgr−Vtp), where Vtp is the threshold voltage of pMOSFET device P31. While maintaining Vdd at a fixed voltage, the current 130 flowing from Vcc through R0, pMOSFET P31, R1, R2 and R3 equals to Vdd'/(R1+R2+R3), while Vdd=Vdd'*(R2+R3)/(R1+R2+R3). The difference between Vdd and Vdd' can be adjusted by the resistance R1 depending on the circuits.

Figure 4:
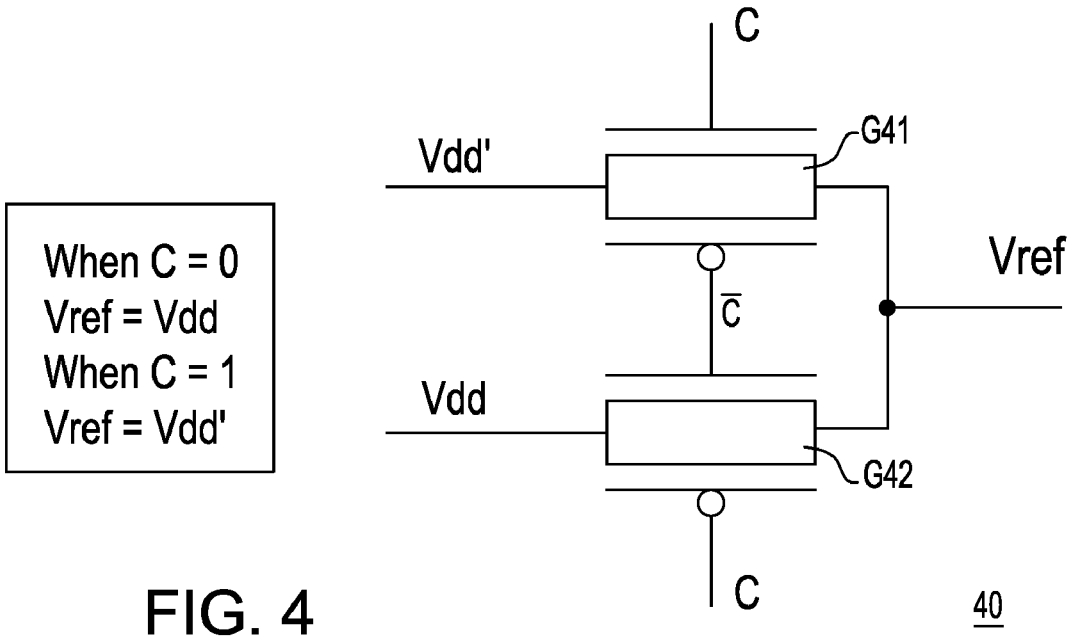
FIG. 4 is a schematic circuit diagram showing the voltage switch, according to the present invention.

Referring to FIG. 4 illustrating the voltage switch, the two voltages Vdd and Vdd' can be switched by a controlling signal C flowing through two pass-gates G41 and G42. If the degradation signal C=1, pass gate G42 opens and Vref=Vdd. Similarly, when the degradation signal C=0, pass-gate G41 opens and Vref=Vdd'.

Figure 5:
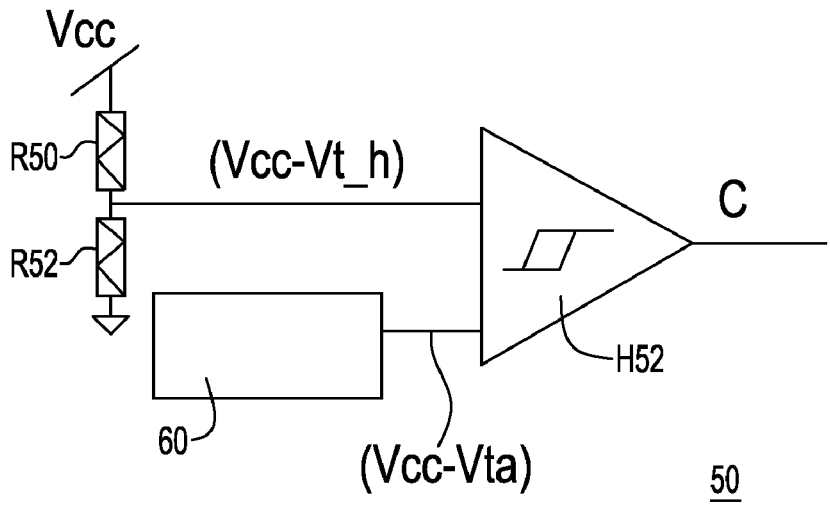
FIG. 5 is a schematic circuit diagram illustrating the threshold voltage monitor, according to the present invention.

Referring to FIG. 5, there is shown a threshold voltage monitor circuit consisting of a threshold voltage regulator circuit block 60 (to be described in detail hereinafter with reference to FIG. 6), a resistive divider consisting of R50 and R52 connected to power supply Vcc, and a hysteresis comparator H52. The latter has a first input providing H52 with a voltage Vcc−Vt_h, wherein Vt_h is the predefined lifetime target threshold voltage, and a second input from the threshold voltage monitor circuit 60 providing H52 with a voltage (Vcc−Vt), where Vt is the threshold voltage of the device under monitoring. Details of the voltage monitor are fully described in U.S. patent application Ser. No. 11/832,796, filed on Aug. 2, 2007, of common assignee, which is incorporated herein by reference in all its details.

Figure 6:
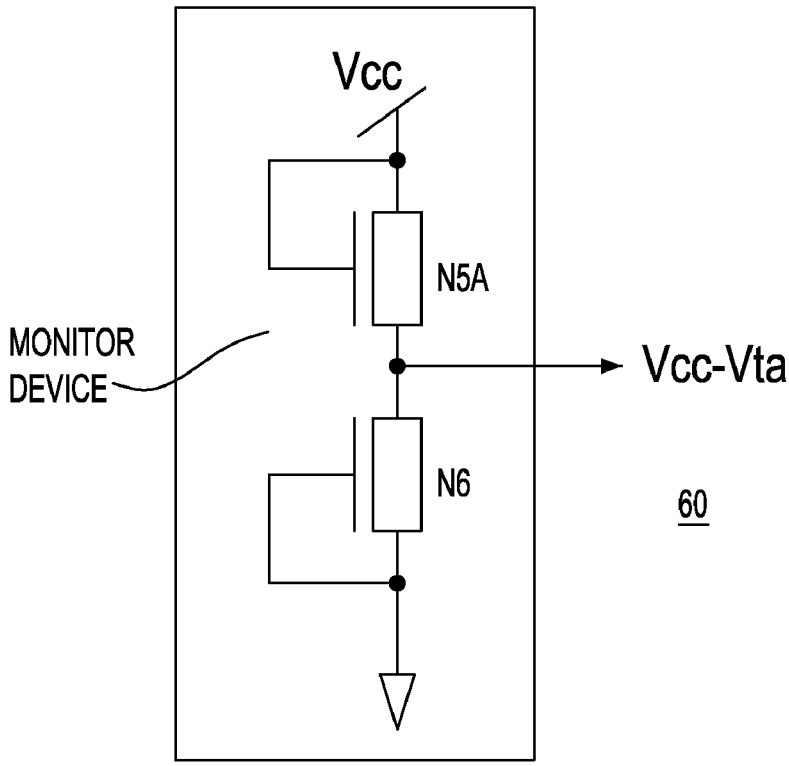
FIG. 6 is a schematic circuit diagram showing the threshold voltage regulator, in accordance to the present invention.

Referring now to FIG. 6, there is shown an exemplary threshold voltage regulator for an nMOSFET monitor device N5A. During normal circuit operation, N5A remains under normal stress with a switching pattern similar to those found in active devices in the main circuit. For the threshold voltage measurement mode described in FIG. 1, the threshold voltage of N5A is measured by way of the circuit shown in FIG. 5, and its threshold voltage value Vt is accurately obtained at the output of threshold voltage regulator 60 by a value determined by (Vcc−Vt). Referring back to the threshold voltage monitor block FIG. 5, Vcc−Vt is compared against reference voltage Vcc−Vt_h, wherein Vcc−Vt_h can be adjusted by tuning the ratio of two resistive elements R50 and R52 of the voltage divider. Vt_h is the maximum allowable threshold voltage degradation (increase) before triggering the extending-lifetime signal C. Either a hysteresis comparator or a conventional comparator can be advantageously used to perform the voltage comparison. The comparators are known in the art and therefore will not be described further.

Figure 7:
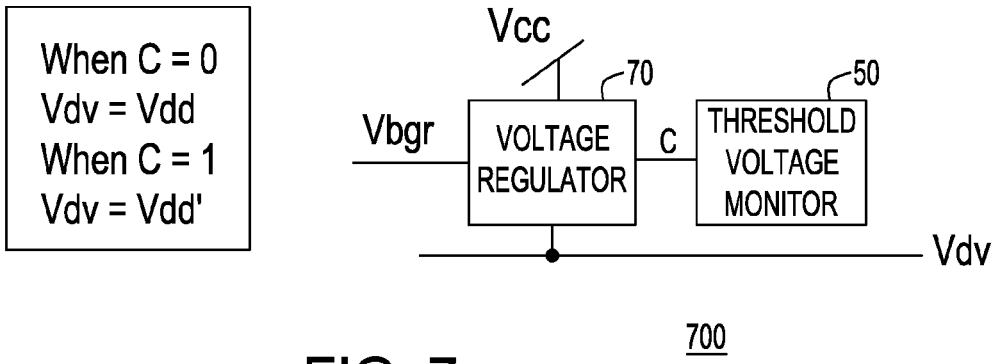
FIG. 7 is a schematic diagram of the voltage regulator attached to the threshold voltage monitor, the combination of which adjusts the supply voltage to its dynamic Vdd value, in accordance with a second embodiment of the invention.

In a second embodiment of a circuit designed to extend the lifetime of a semiconductor chip, there is shown in FIG. 7, a voltage regulator 70 that advantageously replaces reference voltage generator 30 and voltage switch 40 previously illustrated with reference to FIG. 2. In the present embodiment, voltage regulator 70 receives the band-gap reference voltage Vbgr (i.e., a stable reference voltage that is independent of temperature and process variations) and control signal C from the threshold voltage monitor device 50, as described previously with reference to FIG. 5, converting the external voltage level Vcc to an internal voltage level Vdv. When the shift in the threshold voltage of at least one device exceeds a predetermined criterion, it receives a control signal C=1; otherwise C remains at 0.

Figure 8:
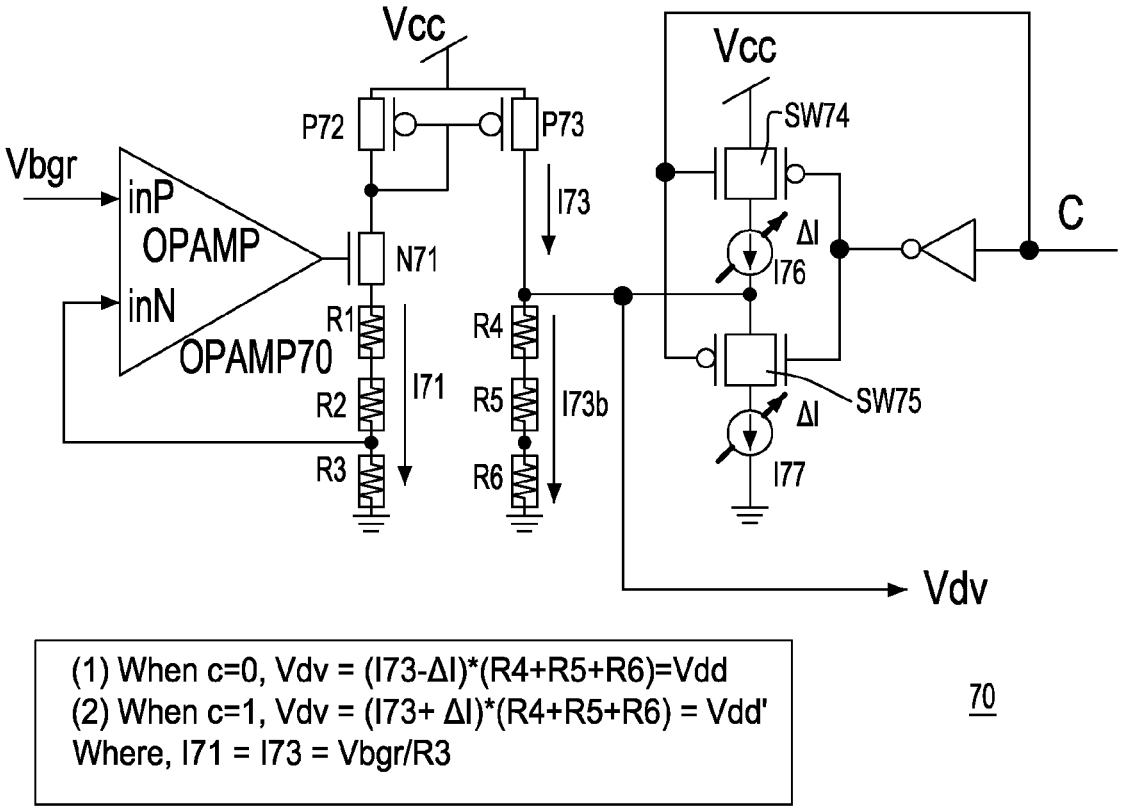
FIG. 8 is a schematic diagram of an operation amplifier whose output tracks band-gap reference voltage Vbgr that automatically adjusts and regulates power supply voltage Vdd.

Summarizing, the output voltage Vdv is preset to Vdd and switched to Vdd' when the state of the control signal C changes (i.e., from 0 to 1, or from 1 to 0), wherein Vdd' differs from Vdd by the amount of shift in threshold voltage ΔVt of the measured device (i.e., Vdd'=Vdd+ΔVt). The value of Vdd' can be dynamically tuned in accordance to the amount of threshold voltage shift ΔVt of the measured device, so that voltage compensation can be performed dynamically and more precisely to extend the circuit lifetime and enhance its performance after its normal operation lifetime. Details of the voltage regulator circuit 70 will be described hereinafter:

Referring to FIG. 8, voltage regulator 70 is provided with an OPAMP (OPAMP70) whose output tracks Vbgr and automatically adjusts and regulates the voltage Vdv. At the source of nMOSFET N71, the current I71 is built and tuned to provide voltage Vdd'=I71*(R1+R2+R3). The current consisting of P72 and P73, I71 is mirrored to I73 so that I73=I71. When the output of threshold voltage monitor 50 switches from 0 to 1 (i.e., when the threshold voltage of the measured device is higher than the reference device by ΔVt), switch SW74 closes and switch SW75 opens. At this time, an additional current ΔI (i.e., the same current increase provided by the threshold voltage monitor 50 when its output state changes from 0 to 1) is provided so that I73*b*=(I73+ΔI). Also, Vdv equals to (Vdd+ΔV), or alternatively, Vdv=(I73+ΔI)*(R4+R5+R6).

When the output of threshold voltage monitor 50 switches from 1 to 0 (i.e., when the threshold voltage of the measured device is lower than the reference device by ΔVt), switch SW75 closes, opening switch SW74. As a result, Vdv=Vdd−ΔVt or, alternatively, Vdv=(I73−ΔI)*(R4+R5+R6). By properly sizing the resistive elements, one obtains a desirable Vdv output voltage before and after tuning to extend the lifetime of the chip.

Summarizing:

When C=0, Vref=Vdd, then (I73−ΔI)*(R4+R5+R6)=Vdd.

When C=1, Vref=Vdd+ΔVt, then (I73+ΔI)*(R4+R5+R6)=Vdd', wherein I71=I73=Vbgr/R3.

In conclusion, circuit 200 shown in FIG. 2 and circuit 700 shown in FIG. 7 raise the on-chip supply voltage from Vdd to Vdd' when the threshold voltage of one or more monitored device exceeds a predetermined target threshold level.

Practitioners of the art will readily appreciate that a plurality of such circuits distributed across the chip may exist to locally monitor the threshold voltage of one or several devices. The devices that are monitored are subject to exactly the same (or slightly higher) stress as other active devices, so that the power supply in at least one portion of the chip increases when the average devices age according to a predefined degradation criterion. In such case, it is desirable to use voltage islands to facilitate the local voltage regulation and adjustment based on degree of chip degradation.

While the present invention has been particularly described in conjunction with exemplary embodiments, it is evident that many alternatives, modifications and variations will be apparent to those skilled in the art in light of the present description. It is therefore contemplated that the appended claims will embrace any such alternatives, modifications and variations as falling within the true scope and spirit of the present invention.

What is claimed is:

1. A method of extending a semiconductor chip lifetime comprising:

monitoring a chip degradation by assessing chip performance parameters or device characteristics;

increasing at least one internal power supply voltage to be activated when the chip degradation reaches an end of lifetime stage; and tuning said at least one internal power supply voltage by adding discrete increments as a function of the chip degradation, said monitoring the chip degradation being performed by a threshold voltage monitor attached to a power supply voltage and outputting a control signal received by a reference voltage regulator, said reference voltage regulator having a reference voltage, an external supply voltage and a control signal as inputs, and an internal supply voltage as an output; said voltage regulator further comprising:

a differential amplifier comprising a first input node, a second input node and an output node, said first input node receiving said reference voltage and said second input node connected to a first set of resistive elements; said output node connected to the gate of a second nMOSFET device; said first set of resistive elements further connected to the source of said second nMOSFET device;

a current mirror circuit comprising a first pMOSFET device and a second pMOSFET device, said first pMOSFET device connected to said second nMOSFET device; both said first pMOSFET device and said second pMOSFET device connected to said external supply voltage; said second pMOSFET device connected to a second set of resistive elements; and a current switch module comprising a first current switch with a nMOSFET and a pMOSFET, a second current switch with a pMOSFET and a nMOSFET, a first adjustable current source, a second adjustable current source, and an inverter, said control signal from said threshold voltage monitor connected to the input of said inverter, said nMOSFET of said first current switch and said pMOSFET of said second current switch, the output of said inverter connected to said pMOSFET of said first current switch and said nMOSFET of said second current switch, the input of said first current switch connected to said external supply voltage, and the output of said first current switch connected the input of said first adjustable current source, the output of said first adjustable current source connected to said internal supply voltage; the input of said second current switch connected to an internal supply voltage, and the output of said second current switch connected to said second adjustable current source, and the output of said second adjustable current switch connected to ground.

2. The method as recited in claim 1 further comprising measuring said chip degradation by probing threshold voltages of at least one device powered by said at least one internal power supply voltage.

3. The method as recited in claim 1 further comprising tuning said at least one internal power supply voltage according to a predetermined level of the chip degradation.

4. The method as recited in claim 3, wherein said tuning said at least one internal power supply voltage is performed automatically and dynamically.

5. The method as recited in claim 3, wherein said tuning said at least one internal power supply voltage is performed by iteratively adding incremental voltage amounts.

6. The method as recited in claim 1, wherein said semiconductor chip is provided with an external power supply and an on-chip voltage regulator, converting said external power supply voltage to an internal power supply voltage, regulating the internal power supply voltage level at a predetermined level based on the chip degradation.

7. An apparatus for extending a semiconductor chip lifetime having an internal power supply voltage tuning circuit comprising;

a threshold voltage monitor attached to a power supply voltage monitoring the threshold of the semiconductor chip and outputting a control signal; and a reference voltage regulator receiving the control signal and generating a tunable supply voltage as an output, an external supply voltage and a control signal as inputs, and an internal supply voltage as an output; said reference voltage regulator further comprising:

a differential amplifier comprising a first input node, a second input node and an output node, said first input node receiving said reference voltage and said second input node connected to a first set of resistive elements; said output node connected to the gate of a second nMOSFET device; said first set of resistive elements further connected to the source of said second nMOSFET device;

a current mirror circuit comprising a first pMOSFET device and a second pMOSFET device, said first pMOSFET device connected to said second nMOSFET device; both said first pMOSFET device and said second pMOSFET device connected to said external supply voltage; said second pMOSFET device connected to a second set of resistive elements;

a current switch module comprising a first current switch with a nMOSFET and a pMOSFET, a second current switch with a pMOSFET and a nMOSFET, a first adjustable current source, a second adjustable current source, and an inverter, said control signal from said threshold voltage monitor connected to the input of said inverter, said nMOSFET of said first current switch and said pMOSFET of said second current switch, the output of said inverter connected to said pMOSFET of said first current switch and said nMOSFET of said second current switch, the input of said first current switch connected to said external supply voltage, and the output of said first current switch connected the input of said first adjustable current source, the output of said first adjustable current source connected to said internal supply voltage; the input of said second current switch connected to an internal supply voltage, and the output of said second current switch connected to said second adjustable current source, and the output of said second adjustable current switch connected to ground.

8. The apparatus as recited in claim 7, wherein said tunable supply voltage is about 10% higher than said semiconductor chip power supply voltage.

9. The apparatus as recited in claim 7, wherein said threshold voltage monitor further comprises;

a resistive divider comprising a set of resistive elements, said set of resistive elements being connected to an external power supply voltage at a first terminal thereof and ground at a second terminal thereof, said threshold voltage regulator comprising at least one monitor nMOSFET and a second nMOSFET device, said threshold voltage regulator being connected to an external power supply voltage at a first terminal thereof and to ground at a second terminal thereof, said threshold voltage regulator outputting a voltage dependent on said threshold voltage of said at least one monitor nMOSFET device; and a hysteresis comparator connected to said set of resistive elements at a first input thereof, and connected to an output of said threshold voltage regulator at a second input thereof, and a control signal outputted from said hysteresis comparator.

10. The apparatus as recited in claim 7, wherein said external power supply voltage ranges between 1.0V to 3.0V, and said internal power supply voltage ranges between 1.0V to 3.5 V.

11. The apparatus as recited in claim 7, wherein said voltage regulator converts said external power supply voltage into an internal power supply voltage and regulates said internal supply at a predetermined level indicative of said chip degradation.

12. The method as recited in claim 1, wherein said chip degradation monitoring is conducted during normal circuit operation.

13. The method as recited in claim 2, wherein measuring said chip degradation by probing threshold voltages of at least one device that comprises threshold voltages which are higher than said at least one device under normal operation mode.

14. The method as recited in claim 1, said end of lifetime is determined when said threshold voltage of said at least one device exceeds a predetermined level.

15. The apparatus as recited in claim 7, wherein said threshold voltage monitor monitors at least one monitor nMOSFET device of said semiconductor chip, trigging said tunable supply voltage to increase the power supply voltage when said threshold voltage of said at least one monitor nMOSFET device exceeds a predetermined value.

16. The apparatus as recited in claim 15, wherein said at least one monitor nMOSFET device is biased under normal circuit operation mode to replicate a bias condition of an active device of an operating circuit.

17. The apparatus as recited in claim 7, wherein said threshold voltage monitor is coupled to said voltage regulator to control the tuning of said internal power supply voltage.

18. The apparatus as recited in claim 17, wherein control of said internal power supply voltage is performed under normal circuit operation mode.

19. The apparatus as recited in claim 11, wherein said internal power supply voltage is regulated under normal circuit operation mode.

* * * * *